US005636479A

United States Patent [19]

Haraldsen et al.

[11] Patent Number: 5,636,479

[45] Date of Patent: Jun. 10, 1997

[54] HAND-RAIL FOR USE IN SHIPS, BUILDINGS

[76] Inventors: Torild Haraldsen, 1, N-1800 Askim; Arne Gerhadsen, Haugland, N-1850 Mysen, both of Norway

[21] Appl. No.: 252,246

[22] Filed: Jun. 1, 1994

Related U.S. Application Data

[63] Continuation-in-part of Ser. No. 938,217, Dec. 14, 1992, abandoned.

[51] Int. Cl.[6] ..... E04H 3/04

[52] U.S. Cl. ..... 52/33; 52/174

[58] Field of Search ..... 52/33, 105, 182, 52/187, 174, 184; 182/18, 106, 230; 116/205, 201

[56] References Cited

U.S. PATENT DOCUMENTS

| | | | |
|---|---|---|---|
| 259,544 | 6/1882 | Howard . | |
| 3,408,025 | 10/1968 | Davis | 52/174 |
| 4,179,160 | 12/1979 | Sabo . | |
| 4,385,586 | 5/1983 | Schriever . | |
| 4,823,524 | 4/1989 | Bednar | 52/182 |
| 4,939,876 | 7/1990 | Berner . | |
| 5,027,741 | 7/1991 | Smith et al. . | |
| 5,065,837 | 11/1991 | Szudy | 52/182 X |

FOREIGN PATENT DOCUMENTS

| | | | |
|---|---|---|---|
| 2224154 | 4/1990 | United Kingdom | 116/205 |
| 8904410 | 5/1989 | WIPO . | |
| 9116513 | 10/1991 | WIPO . | |

*Primary Examiner*—Kien T. Nguyen
*Attorney, Agent, or Firm*—Oppenheimer Poms Smith

[57] ABSTRACT

A hand-rail (3) for use in ships, buildings, etc., which, in order to give an indication of direction to persons who are in the ships or buildings, is designed with projections (4) with a direction-orientated design in the hand-rail's (3) longitudinal direction. By following this direction orientation, it will be possible to find the way to exits or specific locations. A description is also given of possibilities for reversing the hand-rail's guiding direction.

3 Claims, 2 Drawing Sheets

FIG. 1
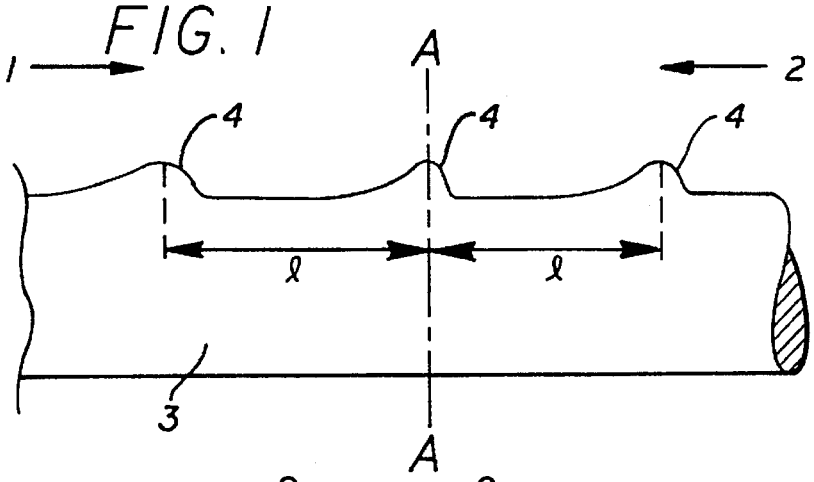
FIG. 2
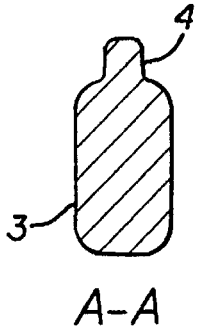
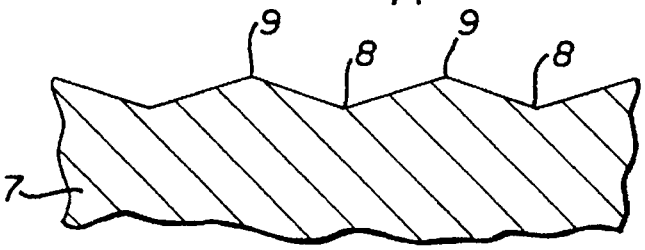
FIG. 3
FIG. 4
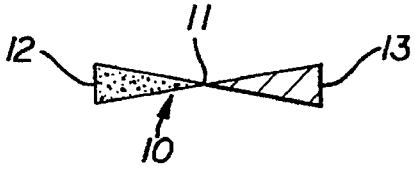
FIG. 5A
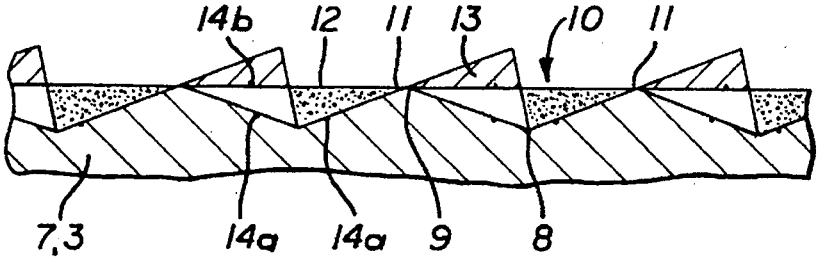
FIG. 5B
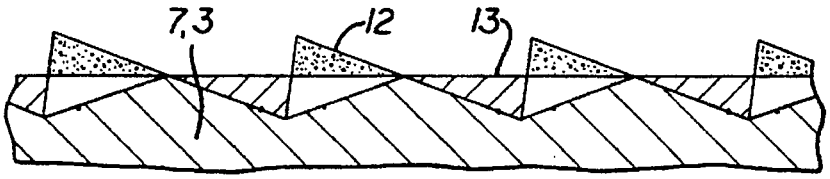

FIG. 6
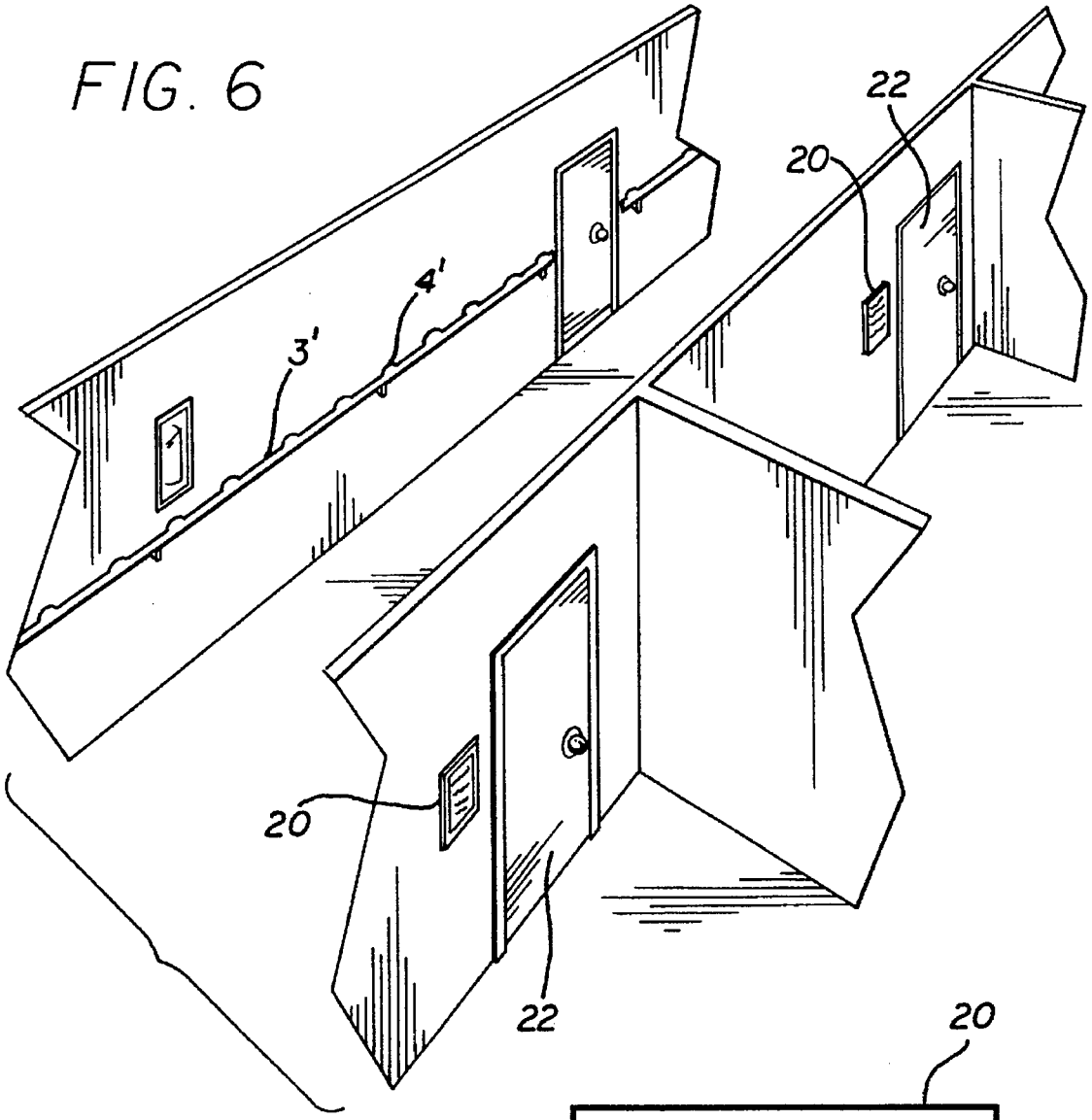
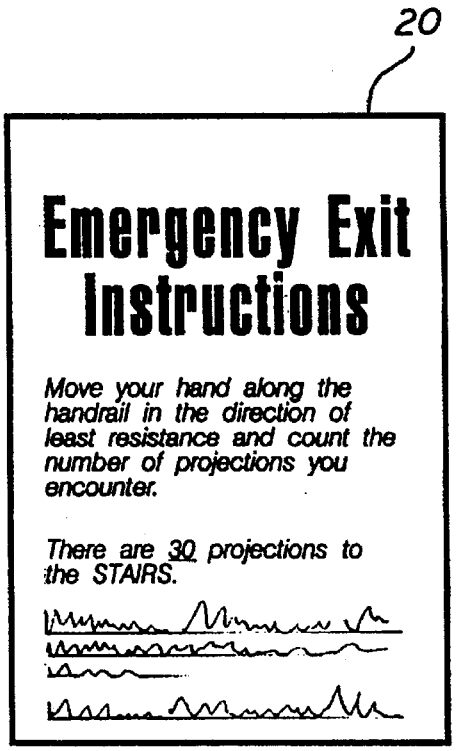
FIG. 7

HAND-RAIL FOR USE IN SHIPS, BUILDINGS

RELATED APPLICATION

This is a continuation-in-part of U.S. patent application Ser. No. 07/938,217, which was filed on Dec. 14, 1992 now abandoned.

BACKGROUND OF THE INVENTION

The invention concerns a hand-rail for use in ships, buildings, etc. The hand-rail is intended for defining a path which persons can follow to an exit in an emergency situation.

Hand-rails are in general use in most places where people are moving around and their main purpose is as a support to hold on to, or as a screen to keep people away from a particular area, or to protect wall sections, etc.

The main object of the present invention is to give the hand-rail the additional function of enabling it to help people to find the way in buildings, on ships, etc. In particular the object is to design a hand-rail capable of providing information concerning the correct escape route to an exit in emergency situations, e.g. in the case of fire, which would be an invaluable help on boats, in large buildings where people are often unfamiliar with the layout, such as hotels, hospitals, old people's homes and in large shops and offices. Moreover, the hand-rail will also provide information on the correct direction in non-emergency situations to persons who have a special need for good information, such as those with poor sight, the blind and children. Such information can also be useful for all persons on a ship or an offshore construction or in a large, complicated building in order to find the way to a main exit.

Particularly in connection with accidents and fires on board ships it has been found that the passengers below decks have lost their sense of direction and have gone round in circles. The thick smoke which develops during a fire impairs sight, and passengers meet closed doors and fail to find the emergency exit quickly enough. Most people search for the main exit, even although there can be several emergency exits closer at hand. Thus there has been a considerable need for a system which can safely indicate the way to the nearest emergency exit.

A further object of the present invention is to provide a cheap, permanent system which can be installed in all kinds of buildings, ships, etc., where people are staying and where it is or can be important to be able to find a guide to lead one in a particular direction, especially towards an emergency exit. The system should be integrated as a natural part of the environment.

Yet another object of the invention is to provide a system whereby the search direction can be reversed in a simple and rapid manner. This reversal of the direction for the escape route should preferably be capable of activation by remote control, but at least by means which are minimally affected by fire.

The above-mentioned objects are achieved by a hand-rail which is characterized by the claims presented.

There are several previously known systems for indicating defined directions, e.g. in passageways. The main method used is signs, light indicators and also light strips, e.g. on the floor. An electrically driven emergency system, e.g., is described in U.S. Pat. No. 4,347,499. According to the system described in this patent, a sensor activates a signal system which emits light signals which indicate a recommended direction of movement, e.g. marked by pulsating lights. The system can also be equipped with sound signal generators and/or sensory devices in the form of vibrators. The system has to be activated, is dependent on electricity and is expensive.

In contrast hereto the basis for the invention is a hand-rail or banister which is a natural and normal part of the environment, particularly in office buildings, hotels, hospitals, nursing homes, ships, etc.

From U.S. Pat. No. 259,544 it is already known such hand-rails used as guides for facilitating speedy exit in case of fire or alarm. That hand-rail has been provided with depressions or projections which act as obstructions when passing the hand in one direction. Such depressions or projections have been distributed over the whole surface of the hand-rail.

Such a construction has, however, some substantial disadvantages. Even if it will be easy to recognize the direction to follow the user has no possibility to know when he will reach the emergency exit, and in a panic situation the depressions will be too small, and due to the distribution over the surface, they finally may not be recognized any more.

SUMMARY OF THE INVENTION

By the present invention there has surprisingly been found that the positioning of the indentations or projections is of very large importance, and that substantial advantages are achieved by positioning projections along a continuous line in order to give a feeling of continuous line in a defined direction. Thereby it is essential to position the projections within specific given distances from each other. The distances between two projections should be kept within approx. 40–70 cm. It has been found that this distance will give the user a feeling of a continuous line, while at the same time the number of projections are kept so low that the user may count the projections. In a ship's cabin, there may then at the cabin door be marked that there are e.g. 30 projections to the stairs or to the exit, or 20 to the corner and then further 10. This will contribute substantially to the security.

If there are provided projections of the type by which the guiding direction may be turned, the number of structure in the alternative direction may simply be given on that side of the cabin door.

A further advantage is that emergency personnel who are going into an emergency zone that is full of smoke may use the number of the projections to find a fire extinguisher, fire hose or a defined cabin in which a person still is in danger.

The number of projections may be given at the exit side or in a control panel.

Again the number of structures must not be too high or too low.

Thus the special embodiment of the invention gives a system which will give the passenger or hotel guest who must escape a safe guiding together with the information necessary to inform him of the way to follow. At the same time the invention will substantially improve the conditions for emergency personnel going into the emergency zone.

The hand-rail design in accordance with the invention achieves the required direction indication by means of very simple methods.

As an emergency instrument, a hand-rail of this kind can naturally be installed at different heights, e.g. at a low height for children, or in the form of a skirting board to protect the wall from wheeled transport in the corridor for normal use and as an emergency indicator in an emergency situation.

The hand-rail in accordance with the invention can also be incorporated in wall constructions and still be designed as proposed.

An alternative embodiment of the present invention provides the possibility of altering the hand-rail's profile direction, so that the escape route can be reversed. This enables either the crew in the ship's control room to reverse the direction by means of a panel in those cases where they know that some of the emergency exits are closed due to fire, or there could be automatic release devices for the reversing operation at strategic points, thus automatically reversing escape routes at special obstacles.

Such a design will mean a further increase in safety and will help everyone to find his way to the correct exit.

In the following section, the invention will be explained in more detail with reference to the drawings.

BRIEF DESCRIPTION OF THE DRAWINGS

FIG. 1 is a side view of a part of a hand-rail, designed in accordance with a first embodiment of the invention, FIG. 2 is a sectional view through a portion of hand-rail in accordance with the line A—A in FIG. 2, FIG. 3 is a schematic side view illustrating a design of the main part of a hand-rail in accordance with a second embodiment of the invention, FIG. 4 is an element to work together with the hand-rail part in FIG. 3, FIGS. 5A and B illustrate the reversibility of the hand-rail profile composed of the elements in FIGS. 3 and 4, and FIG. 6 illustrates one embodiment of a handrail of the type of FIG. 1 in a hallway of a ship; and FIG. 7 illustrates instructions posted at the cabin doors of the ship of FIG. 6.

DETAILED DESCRIPTION OF A PREFERRED EMBODIMENT

In FIG. 1, which illustrates a hand-rail rod viewed from the side, the two directions which can be followed along the hand-rail are indicated by arrows 1 and 2. The hand-rail itself is indicated by 3. On one side of the hand-rail, preferably on the top side in the longitudinal direction of the rail, preferably on the top side in the longitudinal direction of the rail, projections have been provided along a line. These projections have been given a form raising slowly in the direction of the arrow 1 and falling steeply at the end, so that the projection has a nose like form. In the direction of the arrow 2 the nose will act as an obstruction. The projections may be constructed in many different ways. The construction of the projection is not a part of the invention, but may for instance be cut out of wood as an integral part of the hand-rail. Thus if one runs one's hand along the hand-rail rod, by moving one's hand in the direction of the arrow 1, relatively little resistance will be felt, but by running the hand in direction 2, in the direction against the projections 4, a distinct resistance will be felt. By following "the path of least resistance" an indication of the direction leading, e.g., to an emergency exit, a stairway, etc. will be obtained. The line with the projections is preferably positioned on the top side, but may also be placed for instance on the back side. Two parallel lines may also be used. The distance 1 between two projections is between 40 and 70 cm, preferably 50 cm. This means that the distance 1 between two projections is so small that the line will be comprehended as a continuous line, but still with a sufficient distance between the projections making it possible to count them. When information is provided beforehand with respect to the number of projections, the user will know how far he has to go. It should be quite obvious that the projections may be adapted to the form and material of the hand-rail. Thus it is important that the projections will be felt comfortable also in normal use, so that the projections do not reduce the quality of the hand-rail used as such. When using for instance a wooden material for the hand-rail the projections may be formed as smooth long waves with a steep end. The projections may also be used as a guide under normal condition, for instance by children in order to find the right cabin the ship. Emergency personnel, for instance smoke divers, may use the number of projections to find the nearest fire extinguisher or find a certain cabin. Relevant information may be found on a control panel. This use has not been shown on the drawings. In the FIGS. 1 and 2, a design is shown where the patterning is integrated in the actual hand-rail rod, but it should be obvious that this kind of patterning can be added separately as an additional element.

Such a design with an additional element is illustrated in FIGS. 3–5. These figures illustrate a design of the invention in which the guiding direction, i.e. the profile direction, on the hand-rail can be reversed.

FIG. 3 illustrates the basic piece of a hand-rail which is indicated by 7 in the figure and the top of which has been given an "undulating up and down" shape, with lower points 8 and top point 9. On this basis are installed profile elements of the type illustrated in FIG. 4 and which are indicated by 10. The elements consist of two triangular side pieces with a midpoint or fulcrum 11. The side pieces are indicated by 12 and 13 respectively.

In FIG. 5 these elements are assembled to form a banister or hand-rail in accordance with the invention. As shown in the figure, element 10 is installed with its midpoint 11 situated above the top point 9 on the hand-rail part 7 and it is on FIG. 5A placed with the side piece 12 facing the surface of the basic part 7. Thus, the side piece 13 will project above the basic part 7. The next profile piece 10 is then positioned with its midpoint 11 placed on the next top point 9 and is positioned in the same way. The surface of the hand-rail is thereby shaped in such a way as to indicate a particular guiding direction as explained above.

In the example shown the profile pieces 10 are kept in place by means of a magnetic device, in that a magnet 14*a* is placed in the areas beside the lowest points 8, but somewhat displaced in towards the midpoint. The magnetic elements can be electromagnetic and can be remotely controlled in their effect. In the side pieces 12 and 13 magnetic plates 14*b* are installed which can be attracted by the magnets. If the guiding direction has to be reversed, the electromagnets under the side pieces 12 can, e.g., be deactivated, while the electromagnets under the side pieces 13 are activated, and thus the profile piece will pivot round and create a guiding direction in the opposite direction as illustrated on FIG. 5B. Control of this kind using electromagnetic means will be simple for one skilled in the art to provide and is not described in more detail here. It should also be mentioned that even although there has been described here an electromagnetic activation device for the turning or reversing operation, this could also be designed mechanically by means of a rod mechanism or a line or wire traction mechanism, which will be insensitive to the effects of heat and thus be safe to use. Such mechanisms can be released by handles in appropriate places or remotely controlled, but can also be controlled from sensor points at strategic positions which can issue warnings that an emergency exit is blocked so that the escape route has to be reversed or automatically change the direction.

FIG. 6 illustrates one embodiment of a handrail 3' of the type of FIG. 1 in a hallway of a ship. Instructions 20 are posted at the cabin doors 22, instructing the occupant to move his or her hand along the handrail 3' and to count the number of projections 4' that he or she encounters. The posted instructions also state the number of projections between a first location (such as the cabin) and a second location (such as the stairs). FIG. 7 is a detail view of one embodiment of the posted instructions 20.

Many modifications are possible of such reversible profile designs for the hand-rail. In the drawing an example is illustrated where the profile piece 10 is located on a suitable hand-rail surface, but such profile pieces can also be inserted in slots in the hand-rail. Shapes other than those shown can also be used. Similarly, as mentioned, different types of control mechanisms to reverse the orientation of the projections can be used, both manual, mechanical, electrical and electromechanical. The handrail of the present invention may be made of a wide variety of materials, such as wood, metal, composites, and/or fireproof or fire resistant materials. Thus many modifications are possible within the scope of the invention.

What is claimed is:

1. A method for guiding persons out of an enclosed area in an emergency comprising the steps of:

a) providing a handrail having projections that are integral to the handrail, said projections being provided along a line in the longitudinal direction of the hand-rail, said projections being formed to provide resistance when running one's hand in a longitudinal direction along said hand-rail, and providing relatively little resistance when running the hand in the opposite longitudinal direction along said hand-rail; and said projections further being spaced at a distance of approximately 40 to 70 cm between each other, so as to space the projections sufficiently far from one another so that a user may count the projections as he runs his hand over the projections as he walks;

b) posting information near said handrail stating the approximate number of projections on said handrail between a first location and a second location; and c) posting instructions near said handrail instructing a user to move his or her hand along said handrail and to count the number of projections that he or she encounters, whereby the method can guide a user from locations such as rooms, cabins and exits, to other locations such as fire hoses and extinguishers, doors, and exits, even in smoke filled and darkness conditions during an emergency.

2. A method as defined in claim 1, wherein said projections have the profile of a smooth, rounded wave having a relatively shorter, steep face in the front of the wave, a relatively smooth, longer face in the back of the wave, and a rounded top, wherein one may run one's hand from back to front along the smooth, longer face with little resistance but will encounter relatively greater resistance when running one's hand from front to back against the shorter, steep face of the wave, and wherein the rounded top of the wave is free of any sharp point so as to prevent injury to one's hand when quickly grasping the hand-rail in an emergency situation and to prevent items from getting caught on the top of the wave.

3. A handrail safety system for use in ships, buildings, etc. for defining a path which persons can follow in an emergency situation, comprising:

a handrail having projections that are provided along a line in the longitudinal direction of the hand-rail, said projections being formed to provide resistance when running one's hand in a longitudinal direction along said hand-rail, and providing relatively little resistance when running the hand in the opposite longitudinal direction along said hand-rail;

said projections having the profile of a smooth, rounded wave having a relatively shorter, steep face in the front of the wave, a relatively smooth, longer face in the back of the wave, and a rounded top, wherein one may run one's hand from back to from along the smooth, longer face with little resistance but will encounter relatively greater resistance when running one's hand from front to back against the shorter, steep face of the wave, and wherein the rounded top of the wave is free of any sharp point so as to prevent injury to one's hand when quickly grasping the hand-rail in an emergency situation and to prevent items from getting caught on the top of the wave;

said projections further being spaced at a distance of approximately 40 to 70 cm between each other, so as to space the projections sufficiently far from one another so that a user may count the projections as he runs his hand over the projections as he walks; and said system further comprising printed instructions for posting near said handrail stating the approximate number of projections on said handrail between a first location and a second location and instructing a user to move his or her hand along said handrail and to count the number of projections that he or she encounters.

* * * * *